US007811104B2

(12) United States Patent
Matsumura et al.

(10) Patent No.: US 7,811,104 B2
(45) Date of Patent: Oct. 12, 2010

(54) LEVER TYPE CONNECTOR

(75) Inventors: Kaoru Matsumura, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/338,744

(22) Filed: Dec. 18, 2008

(65) Prior Publication Data

US 2009/0163063 A1 Jun. 25, 2009

(30) Foreign Application Priority Data

Dec. 20, 2007 (JP) ..... 2007-328950

(51) Int. Cl.
*H01R 13/62* (2006.01)

(52) U.S. Cl. ..... 439/157; 439/372

(58) Field of Classification Search ..... 439/157, 439/160, 372, 357

See application file for complete search history.

(56) References Cited

U.S. PATENT DOCUMENTS 7,500,860 B2 * 3/2009 Tajiri et al. ..... 439/160
2001/0049215 A1 * 12/2001 Okabe et al. ..... 439/157
2003/0017733 A1 * 1/2003 Fujii ..... 439/157
2003/0199184 A1 * 10/2003 Martin et al. ..... 439/157
2006/0040535 A1 * 2/2006 Koshy et al. ..... 439/157
2007/0128900 A1 * 6/2007 Bauman et al. ..... 439/157
2007/0173091 A1 * 7/2007 Taguchi et al. ..... 439/157

FOREIGN PATENT DOCUMENTS

JP 2005-122942 A 12/2005

* cited by examiner

*Primary Examiner*—Hien Vu
(74) *Attorney, Agent, or Firm*—Sughrue Mion, PLLC

(57) ABSTRACT

Provided is a lever type connector for fitting connectors by swinging a lever 100, in which protrusions 115 and 116 are provided on an outer peripheral portion of the one end side of the lever side plate 102, a reception portion 15A for preventing the lever side plate from opening outward by engaging with the protrusions provided on the outer peripheral portion of the lever side plate in a male connector housing 10H for mounting the lever, and the protrusions 115 and 116 and the reception portion 15A are provided to engage with each other when the lever mounted on at least the male connector housing is set to a temporary locking position before connector fitting.

3 Claims, 14 Drawing Sheets

LEVER TYPE CONNECTOR

BACKGROUND OF THE INVENTION

1. Field of the invention

The invention relates to a lever type connector capable of fitting or separating female and male connector housings with little force by a swing operation of a lever.

2. Description of the Related Art

A lever type connector is provided with a lever that is swingably mounted on one connector housing of a pair of connector housings fitted to each other, and help both connector housings to be fitted and separated by an operation of a cap mechanism provided between the lever and the other connector housing, by a swing operation of the lever.

For example, a lever of a lever type connector described in Patent Document 1 has a swing fulcrum portion (swing hole) fitted to a swing fulcrum portion close to a connector housing on one end side of a pair of left and right lever side plates, and has a substantially U shape having an operation portion connecting both lever side plates to each other on the other side of the lever side plates. The lever has a cap protrusion (or cap groove) engaged with a cap groove (or cam protrusion) of the other connector housing, in the vicinity of the swing fulcrum portion.

In the lever type connector described above, in a step of fitting to an opponent connector in a state where the lever is previously and temporarily kept at a temporary locking portion, the cam groove and the cam protrusion can be engaged with each other even without particularly positioning the lever.

Patent Document 1: JP-A-2005-122942

In such a lever type connector, transport or keeping is performed with the lever kept at the temporary locking position. In this case, a swing fulcrum close to the lever and a swing fulcrum close to the connector housing fitted to each other may deviate from each other, by applying unexpected excessive external force.

SUMMARY OF THE INVENTION

The invention has been made to solve the aforementioned problem, and is to provide a lever type connector with high reliability by preventing an unnecessary deviation accident in the temporary locking of the lever.

According to a first aspect of the invention, there is provided a lever type connector in which a lever is swingably mounted on one connector housing of a pair of connector housings, the lever has a substantially U shape having a pair of lever side plates having a swing fulcrum portion on each end side, and an operation portion connecting the other ends of the pair of lever side plates to each other, the swing fulcrum portion close to the lever is swingably fitted to the swing fulcrum portion provided on the outside of the one connector housing by opening one end side of the pair of lever side plates to the outside, and both of the connector housings are fitted and separated by an operation of a cap mechanism provided with the lever and the other connector housing by a swing operation of the lever, wherein a protrusion is provided on an outer peripheral portion of the one end side of the lever side plate, a reception portion for preventing the lever side plate from opening outward by engaging with the protrusion provided on the outer peripheral portion of the lever side plate in the one connector housing for mounting the lever, and the protrusion and the reception portion are provided to engage with each other when the lever mounted on at least the one connector housing is set to a temporary locking position before connector fitting.

According to a second aspect of the invention, in the lever type connector according to the first aspect, the lever is set to the temporary locking position before connector fitting by swinging the lever about a fulcrum that is a fitting part of fitting both of the swing fulcrums, and a plurality of the protrusions and reception portions are provided to constantly engage with each other, in the course of swinging the lever to the temporary locking position after fitting both of the swing fulcrums.

According to a third aspect of the invention, in the lever type connector according to the first aspect, the one connector housing is configured in bilateral symmetry so that an attachment direction to the one connector housing can be selected in two ways of a first direction and a second direction opposite to the first direction, and the reception portion is provided in bilateral symmetry with respect to a central position of left and right directions of the one connector housing.

According to a fourth aspect of the invention, in the lever type connector according to any one of first to third aspects, the reception portion is provided on outside faces of a front side and a back side of the one connector housing, and the protrusion is provided on each of the pair of lever side plates.

According to the first aspect of the invention, at the time of temporarily locking the lever, the protrusion close to the lever and the reception portions close to the connector housing engage with each other. Accordingly, it is possible to prevent the lever side plate from opening, and thus it is possible to reliably keep the lever not to be separated. For this reason, it is possible to improve reliability of the lever type connector.

According to the second aspect of the invention, some of the protrusions and the reception portions normally engage with each other in the course of swinging the lever from the position of mounting the lever on the connector housing to the temporary locking position. Accordingly, it is possible to prevent the lever from being separated, and it is possible to improve workability of assembly According to the third aspect of the invention, since the reception portion close to the connector housing is provided in bilateral symmetry, it is possible to prevent the lever from being separated irrespective of the direction of attaching the lever to the male connector housing.

According to the fourth aspect of the invention, since the reception portion is provided on the outside faces on the front and back sides of the connector housing, it is possible to prevent the lever side plates from opening with satisfactory balance and thus it is possible to prevent the lever from deviating.

DESCRIPTION OF THE PREFERRED EMBODIMENTS

Hereinafter, an embodiment of the invention will be described with reference to the drawings.

Figure 1:
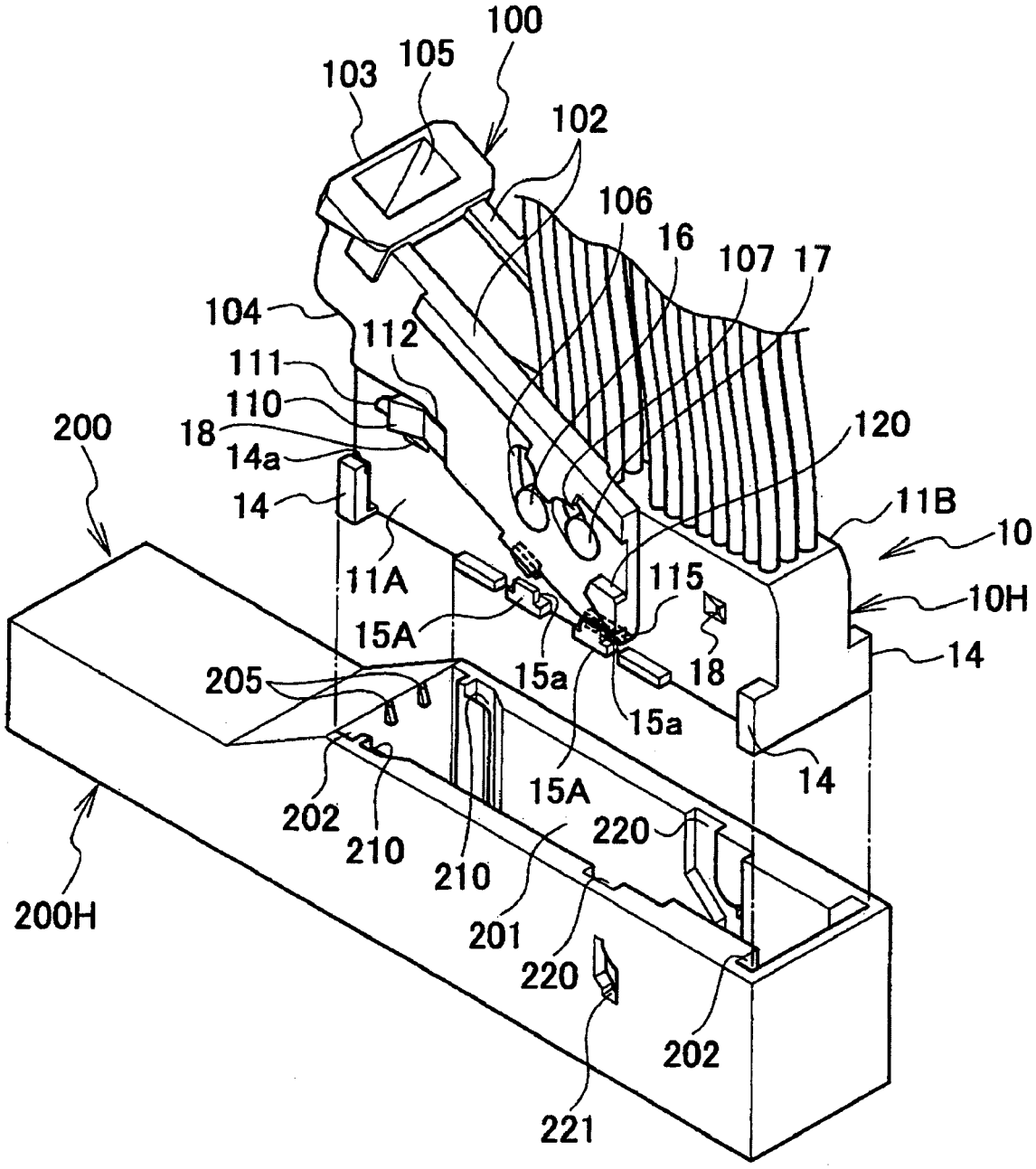
FIG. 1 is a perspective view illustrating a state before fitting of a lever type connector according to an embodiment.
Figure 2:
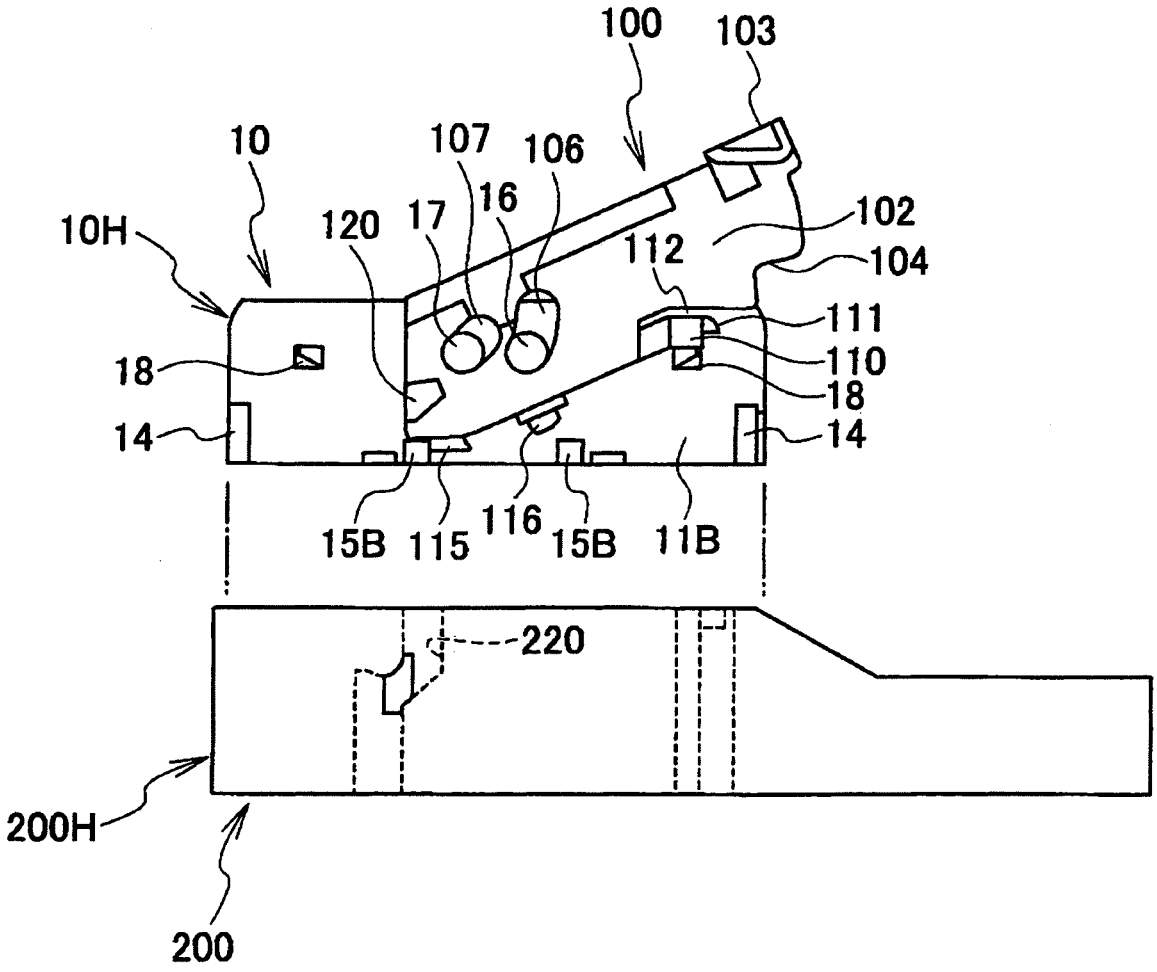
FIG. 2 is a side view as viewed from the side opposite to FIG. 1.
Figure 3:
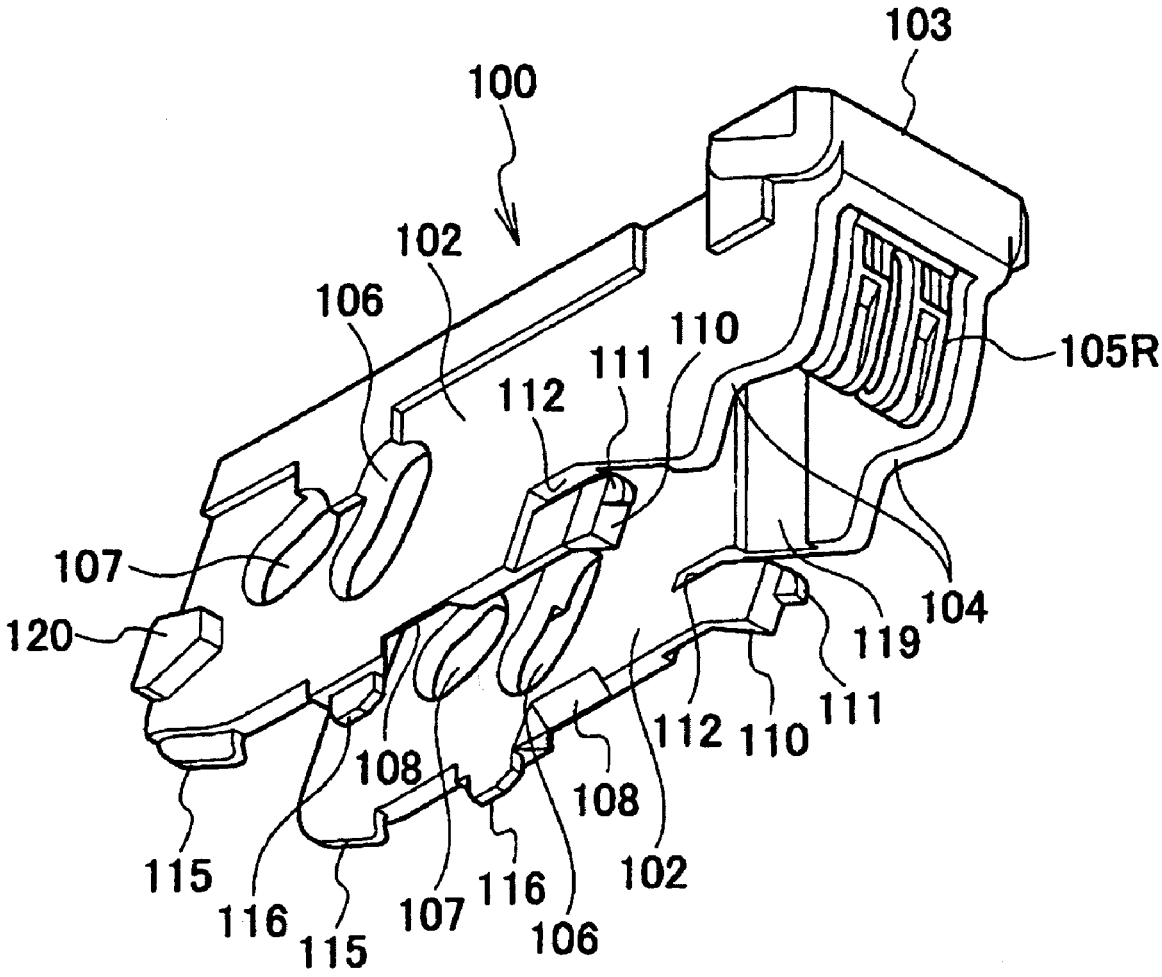
FIG. 3 is a perspective view as viewed from the bottom of a lever.
Figure 4:
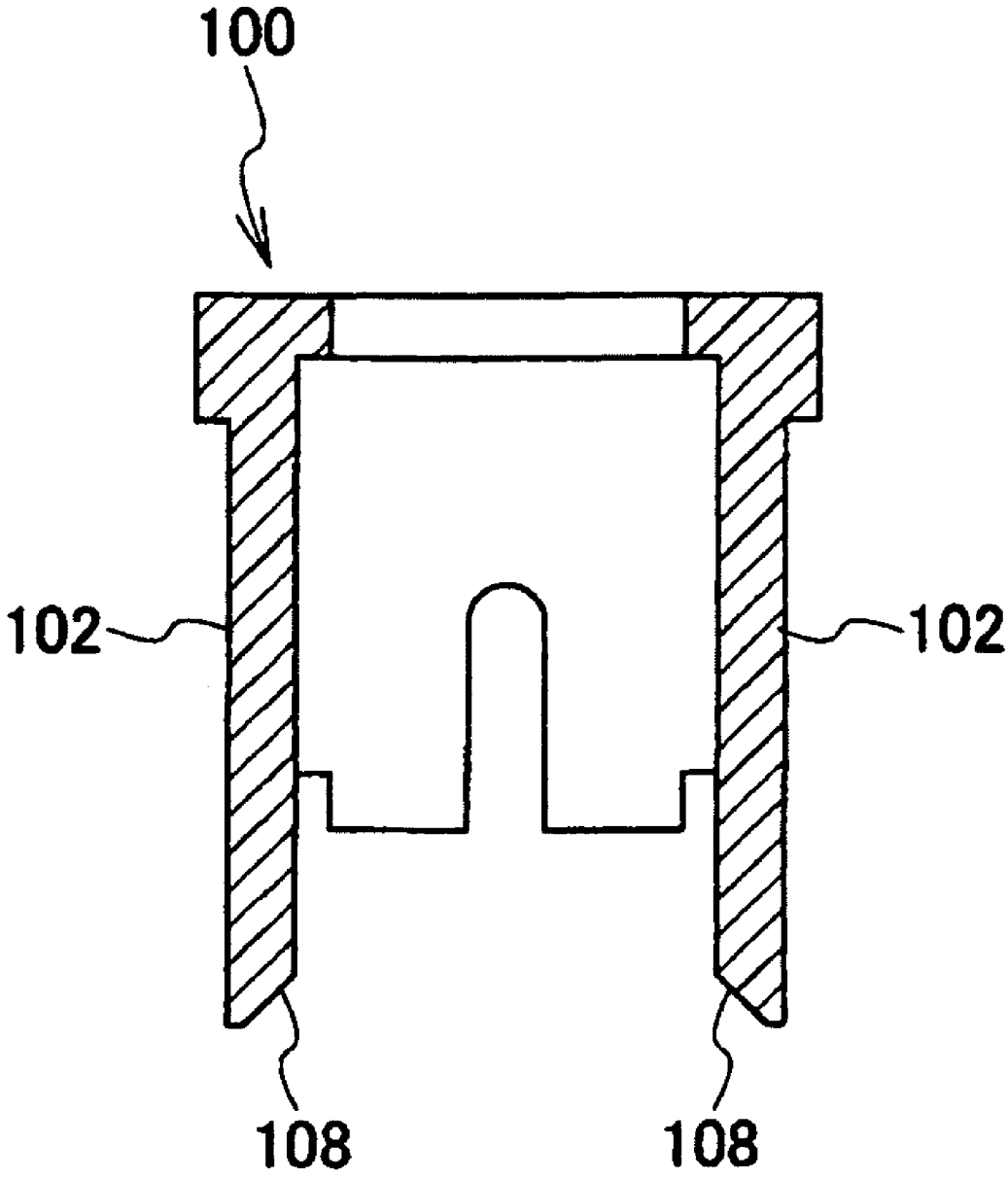
FIG. 4 is a transverse-sectional view illustrating a part provided with a guide slope of the lever.
Figure 5:
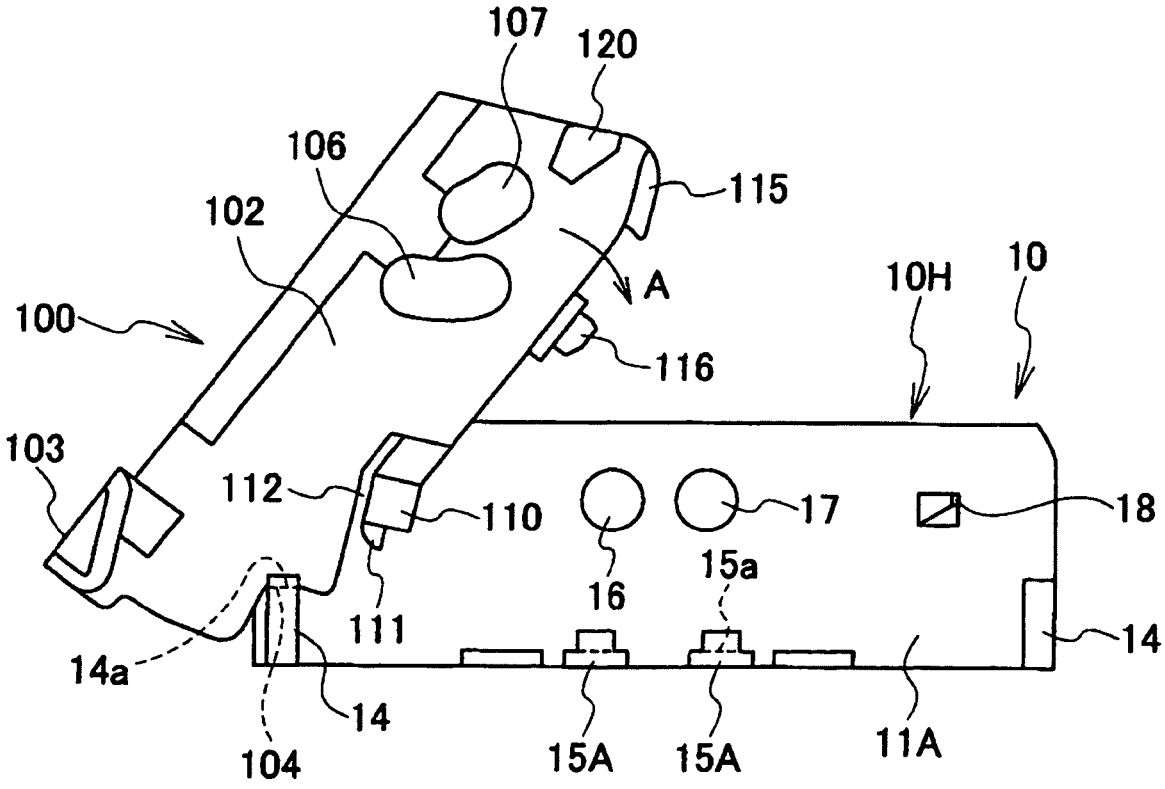
FIG. 5 is a side view illustrating a first step of mounting the lever on a male connector housing.
Figure 6:
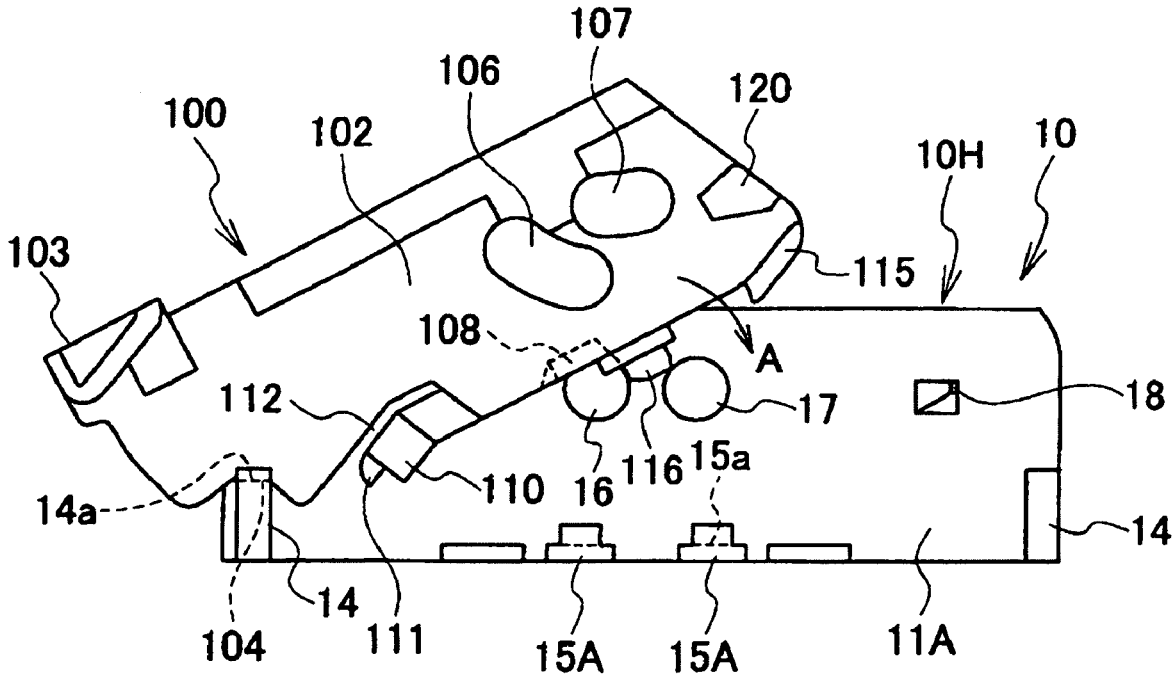
FIG. 6 is a side view illustrating a state of slightly swinging the lever from the state shown in FIG. 5
Figure 7:
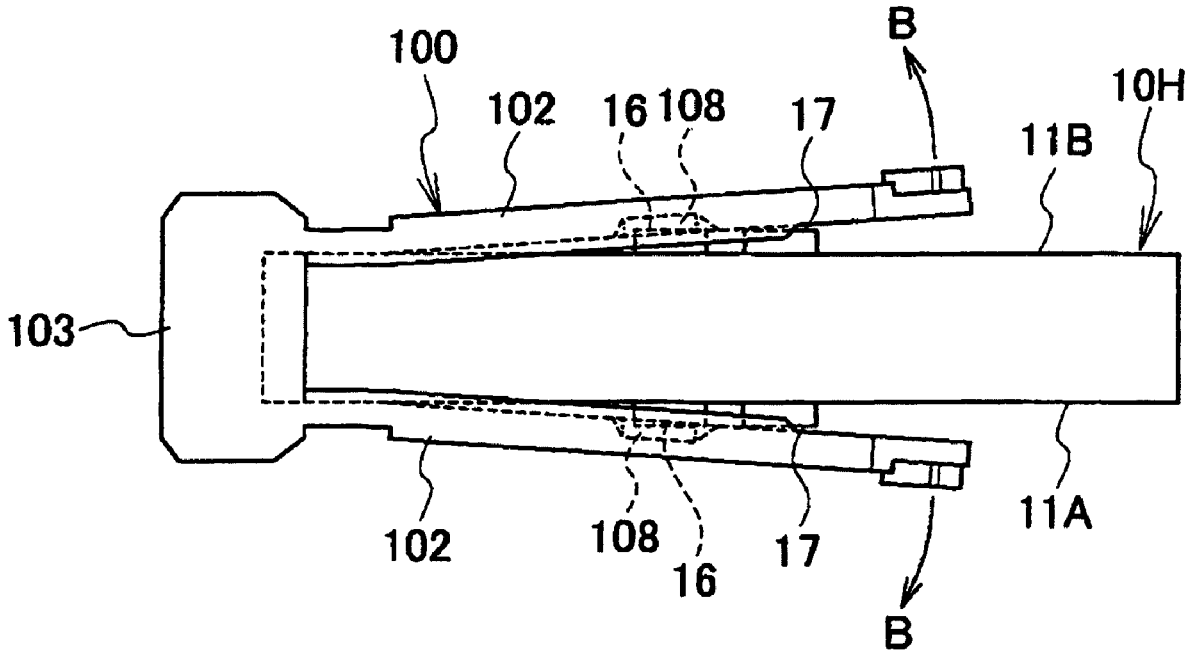
FIG. 7 is a schematic plan view as viewed from the top in the state shown in FIG. 6
Figure 8:
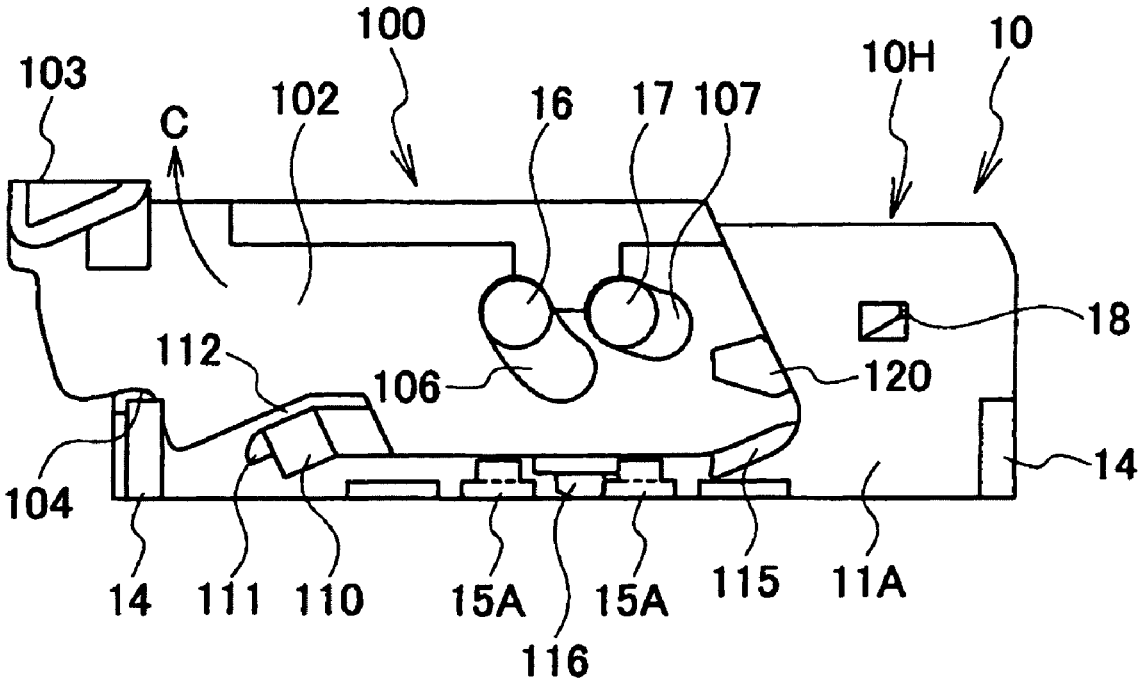
FIG. 8 is a side view illustrating a state before swinging the lever to a temporary locking position in the state of mounting the lever on the male connector.
Figure 9:
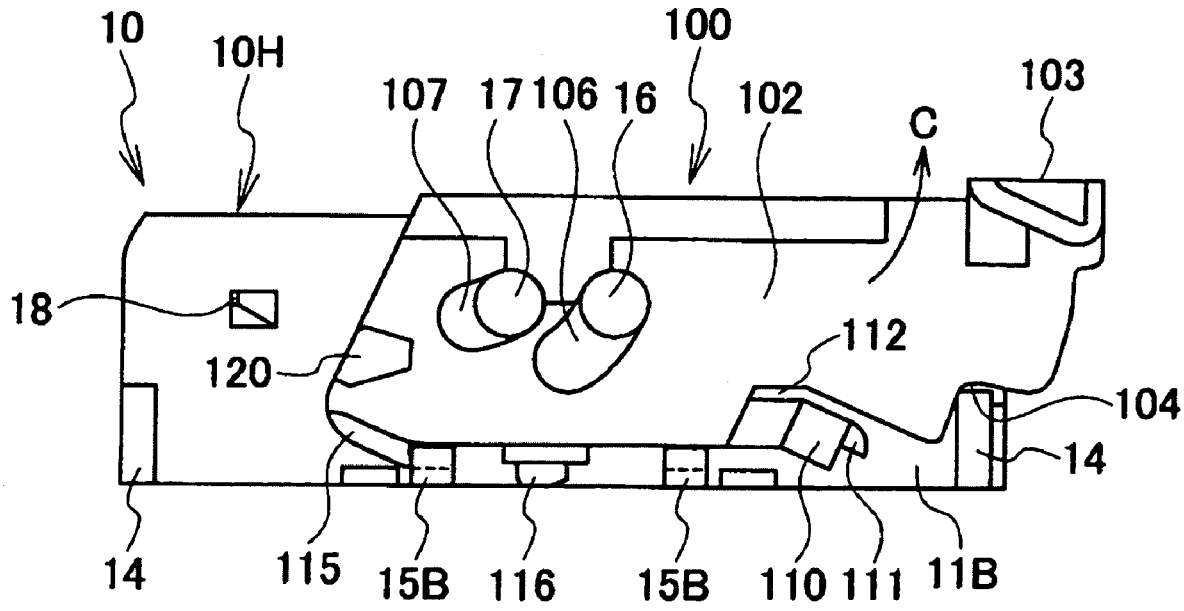
FIG. 9 is a side view as viewed from the side opposite to FIG. 8.
Figure 10:
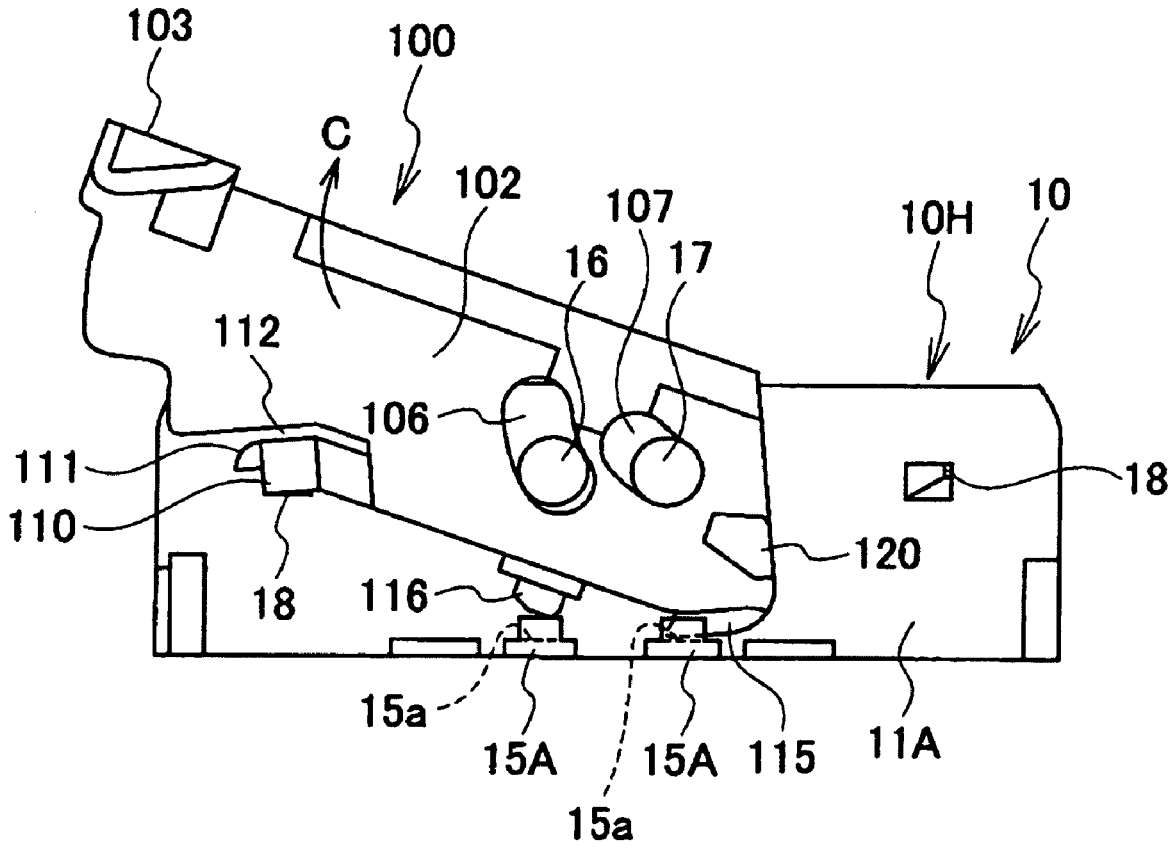
FIG. 10 is a side view illustrating a step in the course of swinging the lever to the temporary locking position from the state shown in FIG. 8.
Figure 11:
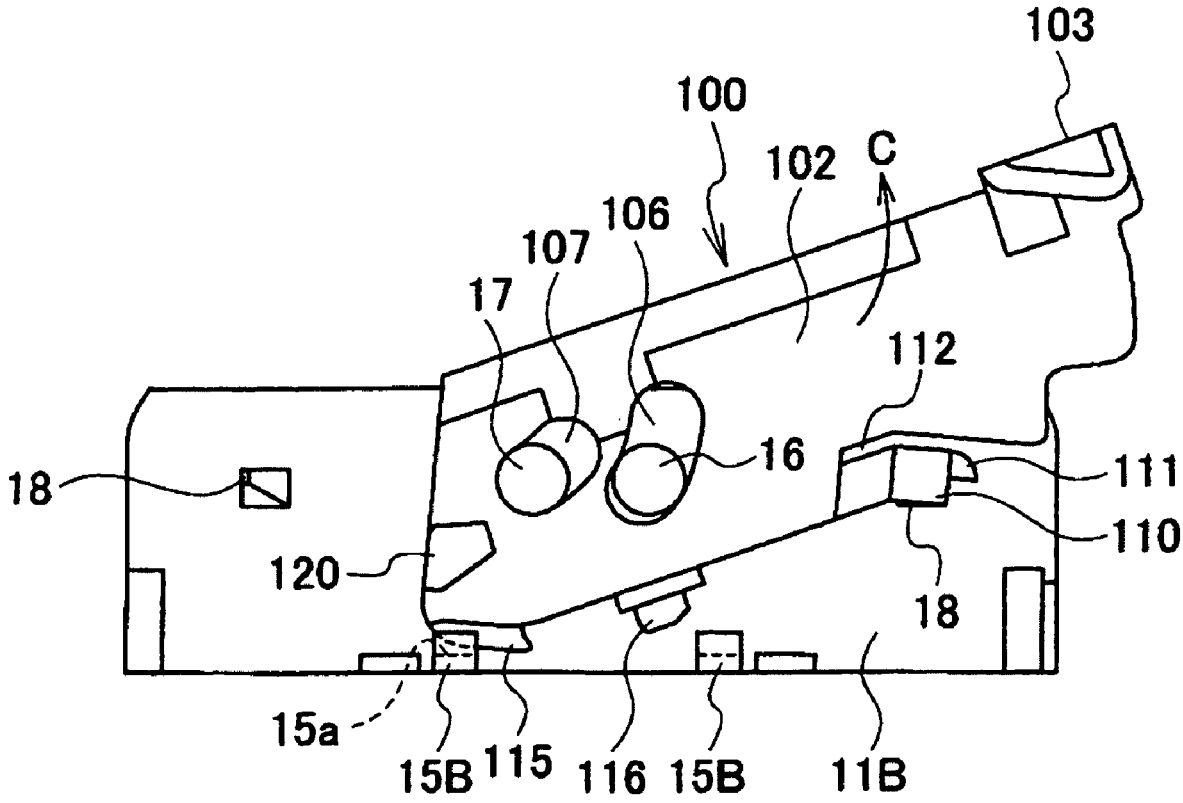
FIG. 11 is a side view illustrating the state shown in FIG. 10 as viewed from the opposite side.
Figure 12:
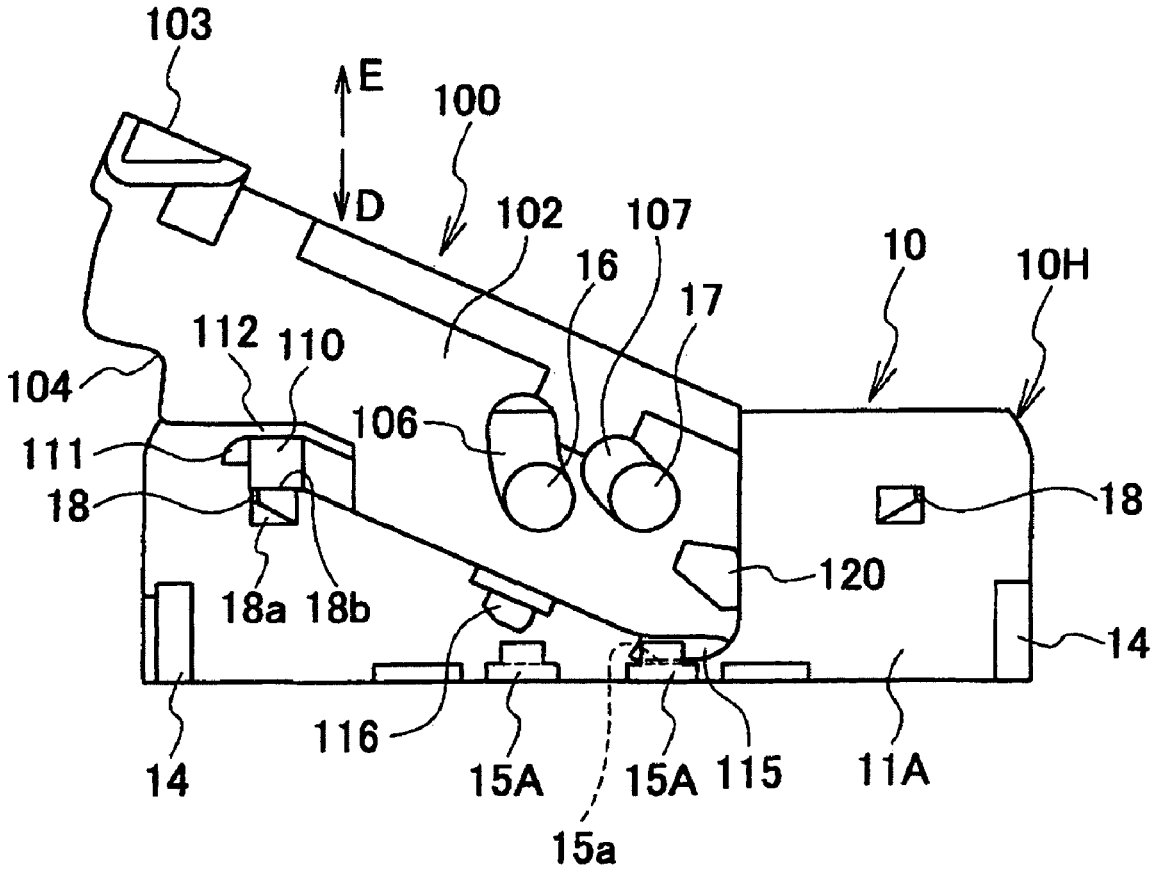
FIG. 12 is a side view illustrating a state of swinging the lever to the temporary locking position.
Figure 13:
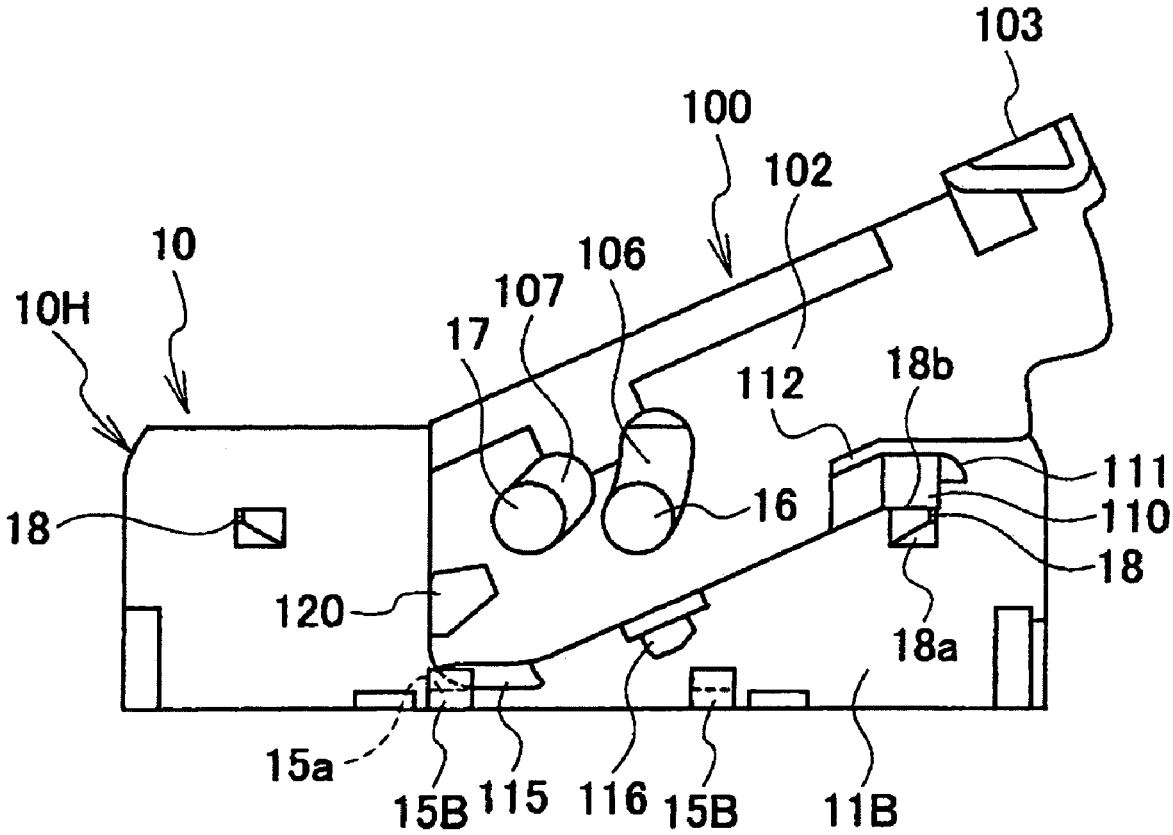
FIG. 13 is a side view illustrating the state shown in FIG. 12 as viewed from the opposite side.

FIG. 1 is a perspective view illustrating a state before fitting of a lever type connector according to an embodiment, FIG. 2 is a side view as viewed from the side opposite to FIG. 1, FIG. 3 is a perspective view as viewed from the bottom of a lever, FIG. 4 is a transverse-sectional view illustrating a part provided with a guide slope of the lever, FIG. 5 is a side view illustrating a first step of mounting the lever on a male connector housing, FIG. 6 is a side view illustrating a state of slightly swinging the lever from the state shown in FIG. 5, FIG. 7 is a schematic plan view as viewed from the top in the state shown in FIG. 6, FIG. 8 is a side view illustrating a state before swinging the lever to a temporary locking position in the state of mounting the lever on the male connector, FIG. 9 is a side view as viewed from the side opposite to FIG. 8, FIG. 10 is a side view illustrating a step in the course of swinging the lever to the temporary locking position from the state shown in FIG. 8, FIG. 11 is a side view illustrating the state shown in FIG. 10 as viewed from the opposite side, FIG. 12 is a side view illustrating a state of swinging the lever to the temporary locking position, and FIG. 13 is a side view illustrating the state shown in FIG. 12 as viewed from the opposite side.

As shown in FIG. 1 and FIG. 2, the lever type connector includes a male connector 10 having a male connector housing 10H provided with a plurality of terminals (now shown), a female connector 200 having a female connector housing 200H provided with a plurality of terminals (not shown), a lever 100 helping the male connector 10 and the female connector 200 to be fitted and separated by a swing operation.

The lever 100 is swingably provided on the male connector housing 10H of the male connector housing 10H and the female connector housing 200H fitted to each other.

The female connector housing 200H has a fitting hole 201 for fitting the male connector housing 10H, and the lever 100 provided on the male connector housing 10H, is configured to be inserted to the fitting hole 201 of the female connector housing 200H together with the male connector housing 10H.

As shown in FIG. 1 to FIG. 4, the lever 100 has a substantially U shape having a pair of lever side plates 102 and 102 having swing holes 106 and 107 on each one end side, an operation portion 103 connecting the other ends of the pair of lever side plates 102 and 102 to each other. One end side of the pair of the lever side plates 102 and 102 is opened outward, thereby swingably fitting the swing holes 106 and 107 to swing fulcrum protrusions 16 and 17 provided on the outside faces 11A and 11B of the male connector housing 10H.

The operation portion 103 of the lever 100 is provided with an opening 105 having a lock arm 105R, and the lock arm 105R is locked to a lock portion 205 (see FIG. 1) provided on an inner wall of the fitting hole 201 of the female connector housing 200H when the male connector 10 is completely fitted to the female connector 200 by swinging the lever 100, thereby keeping a fitting state.

The lever type connector helps both of the connector housings 10H and 200H to be fitted and separated by an operation of a cam mechanism provided between the lever 100 and the female connector housing 200H, by swinging the lever 100. A cam groove 220 constituting the cam mechanism and a cam protrusion 120 engaged with the cam groove 220 are formed on the inside face of the fitting hole 201 of the female connector housing 200H and the outside face of the lever side plate 102, respectively.

Each of the male connector housing 10H, the lever 100, and the female connector housing 200H is formed of one-formed article of resin. A drawing-out hole 221 for drawing out at the time of forming the cam groove 220 is provided on the sidewall of the fitting hole 201 of the female connector housing 200H. A guide groove 202 parallel to a connector fitting direction is formed at the left and right ends of the insides of the opposite side walls of the fitting hole 201.

On the front end side of the outer peripheral portion of the operation portion 3 side of each lever side plate 102, "^"-shaped notch portion 104 is formed. A rib 14 for guide inserted to a guide groove 202 formed in the female connector housing 200H in a sliding manner protrudes on both end faces of left and right direction of the outside faces 11A and 11B of the male connector housing 10H. The ribs 14 are fulcrums of the swing operation at the time of mounting the lever 100 on the male connector housing 10H by engaging the notch portions 104 of the lever side plate 102 with the rib 14 on one end side. A shallow groove 14*a* for easily engaging the notch portion 104 of the lever 100 is formed at the upper end of the rib 14.

As shown in FIG. 3 and FIG. 4, guide slopes 108 are formed on the inner faces of the peripheral portion of both of the lever side plates 102 in the connector fitting direction. When the swing holes 106 and 107 provided on the lever side plates 102 are fitted to the swing fulcrum protrusions 16 and 17 provided on the outside faces 11A and 11B of the male connector housing 10H by swinging the lever 100 about the rib 14 as a fulcrum on the male connector housing 10H side, the guide slope 108 guides the lever side plates 102 to be mounted on the swing fulcrum protrusions 16 and 17 to promote the lever side plates 102 to be opened outward, thereby guiding the fitting of the swing holes 106 and 107 to the swing fulcrum protrusions 16 and 17.

In the embodiment, two swing fulcrum protrusions 16 and 17 and two swing holes 106 and 107 are provided in a direction substantially perpendicular to the connector fitting direction, so that a direction of attaching the lever 100 to the male connector housing 10H can be selected in two ways. The guide slope 108 is provided only at a position corresponding to the swing fulcrum protrusion 16 and the swing hole 106 close to the operation portion 31 of the lever side plate 102.

The lever 100 fits the swing holes 106 and 107 to the swing fulcrum protrusion 16 and 17 by swinging the lever 100 about the rib 14 as a fulcrum in a state of engaging the notch portion 104 with the rib 14. Then, the lever 100 is configured to be set at a temporary locking position before connector fitting by swing the lever 100 in a direction opposite to the mounting of the lever 100 about the fitting portions as a fulcrum of the swing holes 106 and 107 and the swing fulcrum protrusions 16 and 17.

To temporarily keep the lever 100 at the temporary locking position, a flexible temporary locking arm protrudes on the lever side plate 102. A temporary locking protrusion 18 engaged with the temporary locking arm 110 is provided on the outside faces 11A and 11B of the male connector housing 10H.

The temporary locking arm 110 temporarily keeps the lever 100 at the temporary locking position by engaging with the temporary locking protrusion 18, and disposed in a cantilever shape close to the outer peripheral portion on the front side of the lever side plate 102 in the connector fitting direction, with a spilt gap 112 between the lever side plate 102 and the temporary locking arm 110. In a normal state, the temporary locking arm 110 is positioned at a stationary position capable of engaging with the temporary locking protrusion 18. The temporary locking arm 110 is configured to release the engagement with the temporary locking protrusion 18 by bending the lever side plate 102 outward.

An inclined face 18*a* for mounting the temporary locking arm 110 on the temporary locking protrusion 18 while bending outward by sliding to the temporary locking arm 110 is provided on the side face on the front side of the temporary locking protrusion 18 in the connector fitting direction, and a locking wall 18*b* engaging with a section of the temporary locking arm 119 is provided on the side opposite to the inclined face 18*a*.

Figure 14:
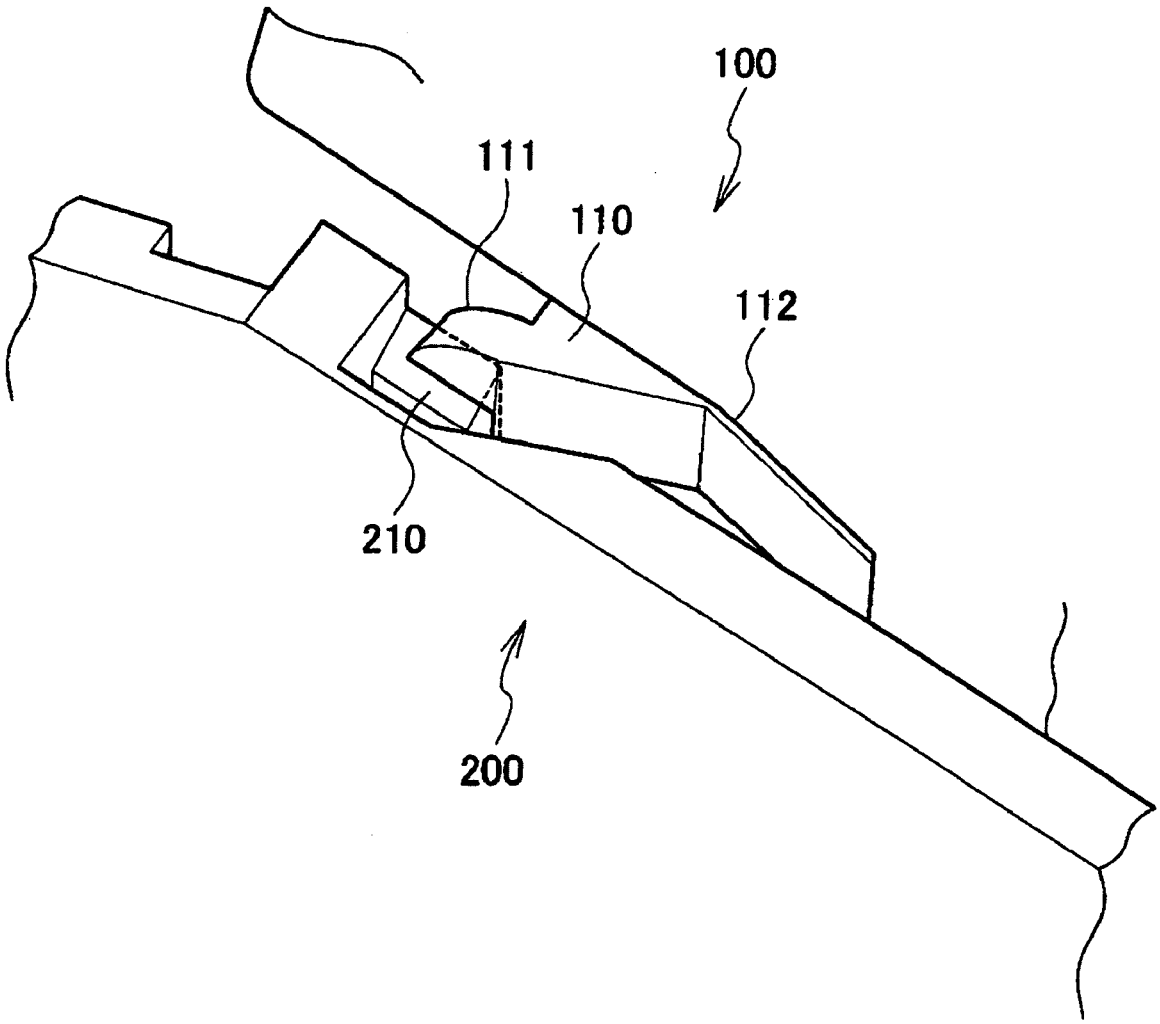
FIG. 14 is a perspective view a relationship between a temporary locking arm close to the lever and a temporary releasing portion close to an arm connector as diagonally viewed from the top, in an initial step of fitting a male connector to a female connector in the state where the lever is set to the temporary locking position.

A temporary releasing protrusion 111 is provided at a front end of the temporary locking arm 110. As shown in FIG. 14, a temporary releasing portion 210 for releasing the locking to the temporary locking protrusion 18 by bending the temporary locking arm 110 outward by interference of the temporary locking protrusion 111 in an initial step for fitting the male connector 10 to the female connector 200 is provided on the inner wall of the fitting hole 201 of the female connector housing 200H.

As shown in FIG. 3, a clearance groove 119 for avoiding the interference of the lever side plate 102 and the temporary locking protrusion 18 at the time of swinging the lever 100 is formed on the inner face of the lever side plate 102.

Protrusions 115 and 116 are provided at the outer peripheral portion on the front side in the connector fitting direction on the side (one end side) opposite to the operation portion 103 of the lever side plate 102. Ring-shaped reception portions 15A and 15A for preventing the lever side plate 102 outward by engaging with the protrusions 115 and 116 provided at the outer peripheral portion of the lever side plate 102 are provided at the front ends of the outside faces 11A and 11B of the male connector housing 10H for mounting the lever 100 in the connector fitting direction. A groove 15*a* through which the protrusions 115 and 116 pass, is formed on the inner side of the reception portion 15A.

The protrusions 115 and 116 and the reception portions 15A and 15B are provided in a positional relation of a plurality of engagement in a normal state in the course of swinging the lever 100 to the temporary locking position after mounting the lever 100 on the male connector housing 10H, and when the lever 100 mounted on the male connector housing 10H is set at the temporary locking position before connector fitting.

In the embodiment, a direction of attaching the lever 100 to the male connector housing 10H can be selected in two ways of a first direction and a second direction opposite to the first direction, and the male connector housing 10H is configured in bilateral symmetry. Accordingly, corresponding thereto, the reception portions 15A and 15B are provided also in bilateral symmetry about the central position in the left and right directions of the male connector housing 10H. As can be seen by comparing FIG. 8 and FIG. 9 with each other, a space between two reception portions 15A of the outside face 11A on the front face is different from a space between two reception portions 15A of the outside face 11B on the back side.

Next, an operation will be described.

To assemble the lever 100 with the male connector housing 10H, as shown in FIG. 5 and FIG. 6, first, "^"-shaped notch portion 104 provided on the lever side plate 102 is hooked to the rib 14 provided at the end portion of the male connector housing 10H. Then, the lever 100 is swung in a direction indicated by the arrow A about the rib 14 as a fulcrum.

Then, the outer peripheral portion of the lever side plate 102 of the lever 100 comes into contact with the swing fulcrum protrusions 16 and 17. At that time, as shown in FIG. 6 and FIG. 7, the swing fulcrum protrusion 16 close to the operation portion 103 comes into contact with the guide slope 108 provided on the inner face of the outer peripheral portion of the lever side plate 102. Accordingly, the lever side plate 102 is opened in a direction indicated by the arrow B shown in FIG. 7 by the operation of the guide slope 108 according to the swinging (putting in) of the lever 100, thereby fitting the swing fulcrum protrusions 16 and 17 to the swing holes 106 and 107.

At this time, the fulcrum of the swing operation is clearly determined by engaging the notch portion 104 with the rib 14. Accordingly, the guide slope 108 is automatically positioned at the swing fulcrum protrusion 16 without particular eye measurement. Therefore, it is possible to mount (fitting of the swing fulcrum protrusions 16 and 17 and the swing holes 106 and 107) the lever 100 only by further swinging the lever 100.

Accordingly, it is unnecessary to perform the positioning while excessively widening the lever side plate 102 using an exclusive jig. Therefore, it is possible to simply fit the swing holes 106 and 107 of the lever side plate 102 to the swing fulcrum protrusions 16 and 17 of the male connector housing 10H with minimum load. As a result, it is possible to improve workability of assembly, and thus it is possible to assemble the lever 100 with the male connector housing 10H with one touch in the air.

In the embodiment, two swing fulcrum protrusions 16 and 17 are provided transversely. However, since the guide slope 108 comes into contact with the swing fulcrum protrusion 16 (on a base end side) close to the operation portion 103 of the lever side plate 102, it is possible to open the lever side plate more widely than the lever side plate 102 with respect to the swing fulcrum protrusion 17 positioned more away from the operation portion 103 of the lever 100 by mounting the lever side plate 102 on the swing fulcrum protrusion 16 by the operation of the guide slope 108. Accordingly, about the swing fulcrum protrusion 17 positioned away from the operation portion 103, it is possible to easily fit the swing hole 107 without a guide slope, and the minimum number of guide slopes 108 may be provided.

As described above, when the lever 100 is assembled with the male connector housing 10H, the lever 100 is in a state shown in FIG. 8 and FIG. 9. At this time, the lever 100 is moved in a direction indicated by the arrow C. That is, a part of the lever 100 close to the operation portion 103 is pulled up about the fitting part of the swing fulcrum protrusions 16 and 17 and the swing holes 106 and 107 as a fulcrum. Then, as shown in FIG. 10 and FIG. 11, the temporary locking arm 110 is mounted on the inclined face 18*a* of the temporary locking protrusion 18. As shown in FIGS. 12 and 13, a bent position returns to a normal position, thereby engaging the temporary locking arm 110 with the locking wall 18*b* of the temporary locking portion 18.

This state is the temporary locking state shown in FIG. 1 and FIG. 2. When the lever 100 is positioned at the temporary locking position, the lever 100 is temporarily locked not to move in a direction indicated by the arrow D or the arrow E shown in FIG. 12. That is, by engaging with the temporary locking protrusion 18 in the direction indicated by the arrow D, the temporary locking arm 110 is locked, and the other interference part serves as a stopper, thereby locking the lever 100. The lever 100 is kept in this state with respect to the male connector, before fitting to the female connector 200.

In the temporary locking state of the lever 100 embodied as described above, the protrusion 115 close to the lever 100 and the reception portions 15A and 15B close to the connector housing 10H engage with each other. Accordingly, it is possible to prevent the lever side plate 102 from opening, and thus it is possible to reliably keep the lever 100 not to be separated. For this reason, it is possible to improve reliability of the lever type connector.

Some of the protrusions 115 and 116 and the reception portions 15A and 15 normally engage with each other in the course of swinging the lever 100 from the position (position shown in FIG. 8 and FIG. 9) of mounting the lever 100 on the male connector housing 10H to the temporary locking position (FIG. 2 and FIG. 13). Accordingly, it is possible to prevent the lever 100 from being separated, and it is possible to improve workability of assembly.

The reception portions 15A and 15B are provided on both of the outside faces 11A and 11B on the front and back sides of the male connector housing 10H. Accordingly, it is possible to prevent both of the lever side plates 102 from opening with satisfactory balance, and thus it is possible to prevent the lever 100 from deviating.

Next, an operation of fitting to the female connector 200 will be described.

The male connector 10 with lever 100 kept at the temporary locking position is first inserted to the fitting hole 201 of the female connector housing 200H. The lever 100 goes into the fitting hole 201 together with the male connector housing 10H. At that time, the rib 14 is guided by the guide groove 202 so as to confront the male connector 10 with the female connector 200 in a correct posture and leading the cam protrusion 120 to an entrance of the cam groove 220.

At the beginning step of this insertion, as shown in FIG. 14, the temporary releasing protrusion 111 provided at the front end of the temporary locking arm 110 comes into contact with the temporary releasing portion 210, and the temporary locking arm 110 is bent outward by the operation of the slope of the temporary releasing portion 210, thereby getting out of the position of engaging with the temporary locking protrusion 18. When the male connector 10 is put into the female connector 200 while pressing the lever 100 toward the female connector 200, the temporary locking state of the temporary locking arm 110 and the temporary locking protrusion 18 is released. Accordingly, the state is in a state capable of putting in while swinging the lever 100. Both of the connectors 10 and 220 are completely fitted by the cam operation of the cam protrusion 120 and the cam groove 220 by swinging and putting the lever 100.

As described above, in the case of the lever type connector, since the lever 100 before connector fitting is kept at the temporary locking position, it is possible to smoothly perform the fitting operation of the female and male connectors 10 and 200 by the operation of the lever 100 from the temporary locking state in which the positions of the cam groove 220 and the cam protrusion 120 are previously matched.

In addition, in the state of fitting the female and male connectors 10 and 200 to each other, since the lever 100 is not exposed outward, the lever type connector can have a compact structure.

In the above description, the case of mounting the lever 100 in the first direction has been described, but the lever 100 may be mounted on the male connector housing 10H in the opposite direction. Also in that case, since the reception portions 15A and 15B close to the male connector housing 10H are disposed in bilateral symmetry, it is possible to prevent the lever 100 from being separated irrespective of the direction of attaching the lever 100 to the male connector housing 10H.

What is claimed is:

1. A lever type connector, comprising:

first and second connector housings; and a lever which is swingably mounted on the first connector housing, wherein:

the first connector housing is receivable into the second connector housing, the lever has a pair of lever side plates having a swing fulcrum portion on each end side, an operation portion connecting the other ends of the pair of lever side plates to each other, and a guide slope formed on inner faces of a peripheral portion of each of the lever side plates, the swing fulcrum portion of the lever is, swingably fitted to a swing fulcrum protrusion by means of the guide slope, the guide slope being contacted with the swing fulcrum protrusion to outwardly deflect at least one end side of the pair of lever side plates when the operation portion of the lever is depressed downwardly on the first connector housing, thus allowing the swing fulcrum protrusion to engage the swing fulcrum portion, the swing fulcrum protrusion being provided on the outside of the first connector housing, a cam mechanism is provided on the lever and is engageable with the second connector housing to cause the first and second connector housings to be fitted together in a completely fitted condition and separated from each other upon rotation of the lever, and a protrusion is provided on an outer peripheral portion of the one end side of the lever side plate, and a reception portion is provided on the first connector housing, the protrusion being received by the reception portion when the lever is in a temporary locking position, prior to complete fitting of the first and second connectors, to prevent the side plates of the lever from being deflected outwardly, wherein the reception is provided on outside faces of a front side and a back side of the first connector housing, and the protrusion is provided on each of the pair of lever side plates.

2. The lever type connector according to claim 1, wherein the lever is adapted to be set to the temporary locking position before fitting together the first and second connector housings by swinging the lever about the swing fulcrum protrusion and wherein the protrusion and reception portion are provided to constantly engage with each other in the course of swinging the lever to the temporary locking position after fitting the swing fulcrum portion to the swing fulcrum protrusion.

3. The lever type connector according to claim 1, wherein the first connector housing is configured in bilateral symmetry so that an attachment direction of the lever to the first connector housing can be selected to be either a first direction or a second direction 180 degrees opposite to the first direction, and the reception portion is provided in bilateral symmetry with respect to a central axis of the first connector housing.

* * * * *